US008854276B2

(12) United States Patent
Koyama et al.

(10) Patent No.: US 8,854,276 B2
(45) Date of Patent: Oct. 7, 2014

(54) PORTABLE TERMINAL

(75) Inventors: Tadashi Koyama, Yokohama (JP); Kunihiko Watanabe, Yokohama (JP)

(73) Assignee: Kyocera Corporation, Kyoto (JP)

( * ) Notice: Subject to any disclaimer, the term of this patent is extended or adjusted under 35 U.S.C. 154(b) by 491 days.

(21) Appl. No.: 13/141,926

(22) PCT Filed: Dec. 25, 2009

(86) PCT No.: PCT/JP2009/007308
§ 371 (c)(1),
(2), (4) Date: Jun. 23, 2011

(87) PCT Pub. No.: WO2010/073722
PCT Pub. Date: Jul. 1, 2010

(65) Prior Publication Data

US 2011/0273358 A1 Nov. 10, 2011

(30) Foreign Application Priority Data

Dec. 25, 2008 (JP) ..... 2008-331584

(51) Int. Cl.
*H01Q 3/24* (2006.01)
*H01Q 1/24* (2006.01)

(52) U.S. Cl.
CPC ..... *H01Q 1/243* (2013.01); *H01Q 3/24* (2013.01); *H01Q 1/24* (2013.01)
USPC ..... 343/876

(58) Field of Classification Search
USPC ..... 343/876, 702; 455/575.7
See application file for complete search history.

(56) References Cited

U.S. PATENT DOCUMENTS

| | | | | |
|---|---|---|---|---|
| 7,532,168 | B2 * | 5/2009 | Nakanishi et al. | 343/702 |
| 7,602,344 | B2 * | 10/2009 | Park et al. | 343/702 |
| 8,521,240 | B2 * | 8/2013 | Nishizono et al. | 455/575.4 |
| 8,606,195 | B2 * | 12/2013 | Suetake et al. | 455/82 |
| 2004/0219956 | A1 * | 11/2004 | Iwai et al. | 455/575.3 |
| 2008/0143609 | A1 | 6/2008 | Mashima et al. | |
| 2009/0131129 | A1 | 5/2009 | Yamazaki et al. | |

FOREIGN PATENT DOCUMENTS

| | | | |
|---|---|---|---|
| EP | 1 555 716 | A1 | 7/2005 |
| JP | 2001-67967 | A | 3/2001 |
| JP | 2006-166370 | A | 6/2006 |
| JP | 2006-245866 | A | 9/2006 |
| JP | 2007-104468 | A | 4/2007 |
| WO | 2005/029638 | A1 | 3/2005 |
| WO | 2006/046714 | A1 | 5/2006 |

OTHER PUBLICATIONS

Patent Abstracts of Japan, machine translation of JP 2001-067967, published Mar. 16, 2001, Applicant: Maruyasu Industries Co. Ltd.
Patent Abstracts of Japan, machine translation of JP 2006-245866, published Sep. 9, 2006, Applicant: Sony Ericsson Mobile Communications Japan, Inc.
Patent Abstracts of Japan, machine translation of JP 2007-104468, published Apr. 19, 2007, Applicant: Matsushita Electric Ind. Co. Ltd.

* cited by examiner

*Primary Examiner* — Seung Lee
(74) *Attorney, Agent, or Firm* — Hoffmann & Baron, LLP

(57) ABSTRACT

A portable terminal suppresses reduction of antenna sensitivity. A portable telephone includes an actuating side casing, display side casing, open-close sensor, circuit disposed on the actuating side casing and includes a ground part, power supply part and signal processing part, first conducting part disposed on the actuating side casing and connected to the ground part, second conducting part disposed on the display side casing and connected to the power supply part, antenna element, receiver disposed opposite the antenna element when the telephone is closed, switching part.

5 Claims, 6 Drawing Sheets

PORTABLE TERMINAL

CROSS-REFERENCE TO RELATED APPLICATIONS

This application is the National Stage of International Application No. PCT/JP2009/007308, filed Dec. 25, 2009, which claims the benefit of Japanese Application No. JP 2008-331584, filed Dec. 25, 2008, the contents of which is incorporated by reference herein.

TECHNICAL FIELD

The present invention relates to a mobile terminal device such as a cellular telephone device.

BACKGROUND ART

Conventionally, a cellular telephone device as a mobile terminal device has been known, which includes a first body, a second body, and a connecting portion connecting the first body and the second body, and which is configured so as to be capable of transitioning to an opened state and a closed state via the connecting portion depending on the usage aspects. A cellular telephone device of such a folder type has a communication function to perform communication externally via an antenna.

For example, Patent Document 1 proposes a cellular telephone device, in which an antenna element disposed in the first body can be utilized as an antenna in the closed state, and in which one of a first conductive portion disposed in the first body and a second conductive portion disposed in the second body can be utilized as an antenna in the opened state, by feeding power to one of the first conductive portion and the second conductive portion and by grounding the other one (in a ground state).

Patent Document 1: Japanese Unexamined Patent Application, Publication No. 2007-104468

DISCLOSURE OF THE INVENTION

Problems to be Solved by the Invention

However, in the cellular telephone device proposed in Patent Document 1, the second conductive portion is positioned in a position superimposed with the antenna element when the first body and the second body are in the closed state; therefore, there has been a problem that the antenna sensitivity is reduced when utilizing the antenna element. In a case of attempting to solve such a problem by employing a configuration in which the second conductive portion is not disposed in a position superimposed with the antenna element in the closed state, the length of the second conductive portion is shorter than the first conductive portion; therefore, there has been a problem that the antenna sensitivity is reduced when one of the first conductive portion and the second conductive portion is utilized as an antenna in the opened state.

Therefore, an object of the present invention is to provide a mobile terminal device in which the reduction of antenna sensitivity is suppressed.

Means for Solving the Problems

The present invention relates to a mobile terminal device that includes: a first body and a second body that are connected to be capable of transitioning between an opened state and a closed state; a detecting unit that detects the opened state and the closed state; a circuit unit that is disposed in one of the first body or the second body, and has a ground unit, a power feed unit, and a signal processing unit connected to the ground unit and the power feed unit; a first conductive portion that is disposed in the first body, and is connected to one of the ground unit and the power feed unit of the circuit unit; a second conductive portion that is disposed in the second body, and is connected to the other one of the ground unit and the power feed unit of the circuit unit; an antenna element that is disposed in the first body; an electronic component that is disposed in the second body in correspondence with the antenna element in a case in which the first body and the second body are in the closed state; a switching unit that is configured to be capable of selecting from a first connection state in which the second conductive portion and the electronic component are connected at high frequency, and a second connection state in which the second conductive portion and the electronic component are cut off at high frequency as compared to the first connection state; and a control unit that causes the switching unit to select the first connection state in a case in which the opened state is detected by the detecting unit, and causes the switching unit to select the second connection state in a case in which the closed state is detected by the detecting unit.

Moreover, it is preferable that the mobile terminal device further includes a high-frequency cutoff unit having a coil or a capacitor, and the second conductive portion and the electronic component are connected via the high-frequency cutoff unit in the second connection state.

In addition, it is preferable that the electronic component is configured to be capable of inputting or outputting sound, and is disposed so as to be exposed in the second body in the closed state.

Furthermore, it is preferable that the electronic component includes one of a receiver, a microphone, IrDA and an external connector.

Moreover, it is preferable that the electronic component is disposed adjacently to the second conductive portion in a longitudinal direction of the second body, the antenna element is disposed adjacently to the first conductive portion in a longitudinal direction of the first body, and a length obtained by summation of a length of the first conductive portion in the longitudinal direction of the first body and a length of the antenna element in the longitudinal direction of the first body is substantially equal to a length obtained by summation of a length of the second conductive portion in a longitudinal direction of the second body and a length of the electronic component in the longitudinal direction of the second body.

Moreover, it is preferable that the mobile terminal device further includes a sub switching unit that is configured to be capable of selecting from a third connection state in which the ground unit and the antenna element are connected, and a fourth connection state in which the signal processing unit and the antenna element are connected, in which the control unit causes the sub switching unit to select the third connection state in a case in which the opened state is detected by the detecting unit, and causes the sub switching unit to select the fourth connection state in a case in which the closed state is detected by the detecting unit.

Effects of the Invention

According to the mobile terminal device of the present invention, the reduction of antenna sensitivity is suppressed.

PREFERRED MODE FOR CARRYING OUT THE INVENTION

Figure 1:
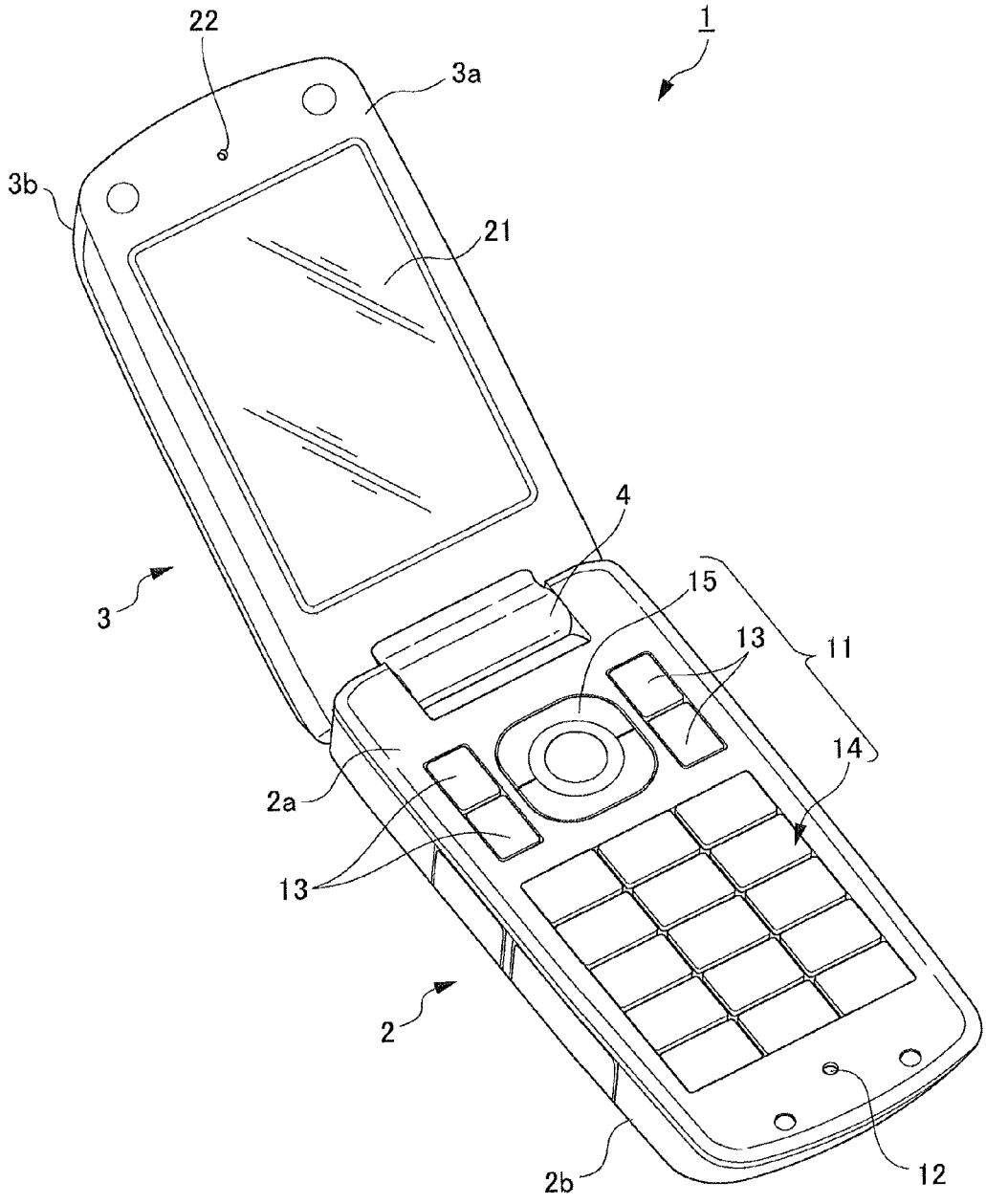
FIG. 1 is a perspective view showing an appearance of a cellular telephone device according to an embodiment of the present invention.

A preferred embodiment for carrying out the present invention is hereinafter described with reference to the drawings. A basic structure of a cellular telephone device 1 as a mobile terminal device according to one preferable embodiment of the present invention is described with reference to FIG. 1. FIG. 1 is a perspective view showing an appearance of the cellular telephone device 1 in an opened state.

As shown in FIG. 1, the cellular telephone device 1 includes: an operation unit side body 2 as a first body; and a display unit side body 3 as a second body. The operation unit side body 2 and the display unit side body 3 are connected so as to be openable and closable via a connecting portion 4 including a hinge mechanism. More specifically, an upper end portion of the operation unit side body 2 and a lower end portion of the display unit side body 3 are connected via the connecting portion 4. As a result, the cellular telephone device 1 is configured so as to be capable of forming opened/closed states by relatively moving the operation unit side body 2 and the display unit side body 3 connected via the hinge mechanism. In other words, the cellular telephone device 1 can be arranged into an opened state where the operation unit side body 2 and the display unit side body 3 are apart from each other, and into a folded state where the operation unit side body 2 and the display unit side body 3 are contacting each other, by relatively rotating (pivoting) the operation unit side body 2 and the display unit side body 3, which are connected via the connecting portion 4.

An outer surface of the operation unit side body 2 is configured with a front case 2*a* and a rear case 2*b*. The operation unit side body 2 is configured to expose, on the front case 2*a* side, an operation key set 11 and a microphone 12 as a sound input unit to which sound produced by a user of the cellular telephone device 1 during a phone call is input.

The operation key set 11 has: function setting operation keys 13 for operating various functions such as for various settings, a telephone number directory function and a mail function; input operation keys 14 for inputting the digits of a telephone number, characters for mail, and the like; and a selection operation key 15 for performing selection of the various operations, scrolling up, down, left and right, etc. Predetermined functions are assigned (key assignment) to each key configuring the operation key set 11 in accordance with the opened/closed state of the operation unit side body 2 and the display unit side body 3, various modes, and the type of application that is running. An operation corresponding to a function assigned to each key is executed by the user depressing each key.

The microphone 12 is disposed to an outer end side (lower end side) that is opposite to the connecting portion 4 side in a longitudinal direction of the operation unit side body 2. In other words, the microphone 12 is disposed to one outer end side of the cellular telephone device 1 in the opened state.

An interface (not illustrated) for communicating with an external device (for example, a host device) is disposed on one side face of the operation unit side body 2. Side keys, to which predetermined functions are assigned, and an interface (not illustrated) where external memory is inserted and removed are disposed on another side face of the operation unit side body 2. Each interface is covered with a cap. When not in use, each interface is covered with a cap.

An outer surface of the display unit side body 3 is configured with a front case 3*a* and a rear case 3*b*. On the front case 3*a* of the display unit side body 3, a display unit 21 for displaying a variety of information, and a receiver 22 that outputs sound of the other party of a phone call are disposed so as to be exposed to the outside. Here, the display unit 21 is configured with a liquid crystal display panel, a drive circuit that drives the liquid crystal display panel, a light source unit such as a backlight that irradiates light from the back face side of the liquid crystal display panel, etc.

Figure 2:
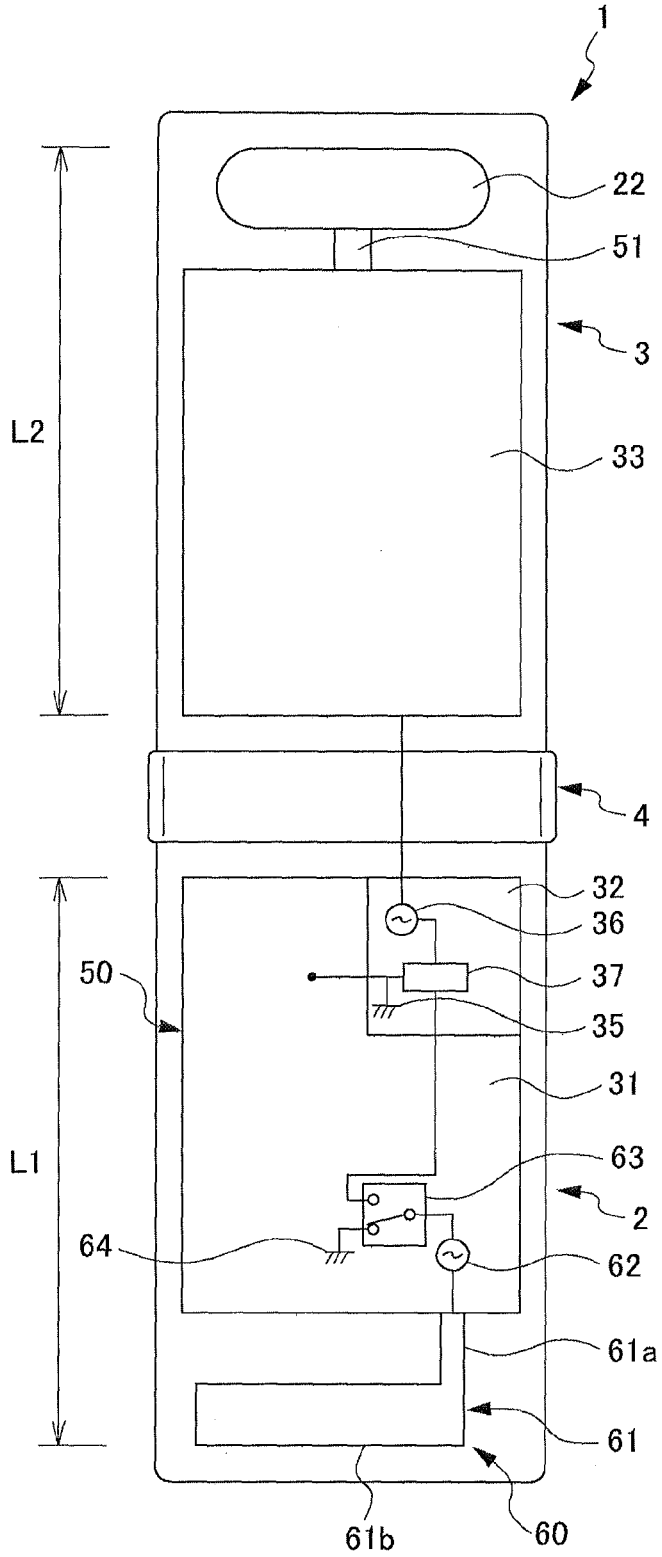
FIG. 2 is a front view schematically showing an opened state of the cellular telephone device.
Figure 3:
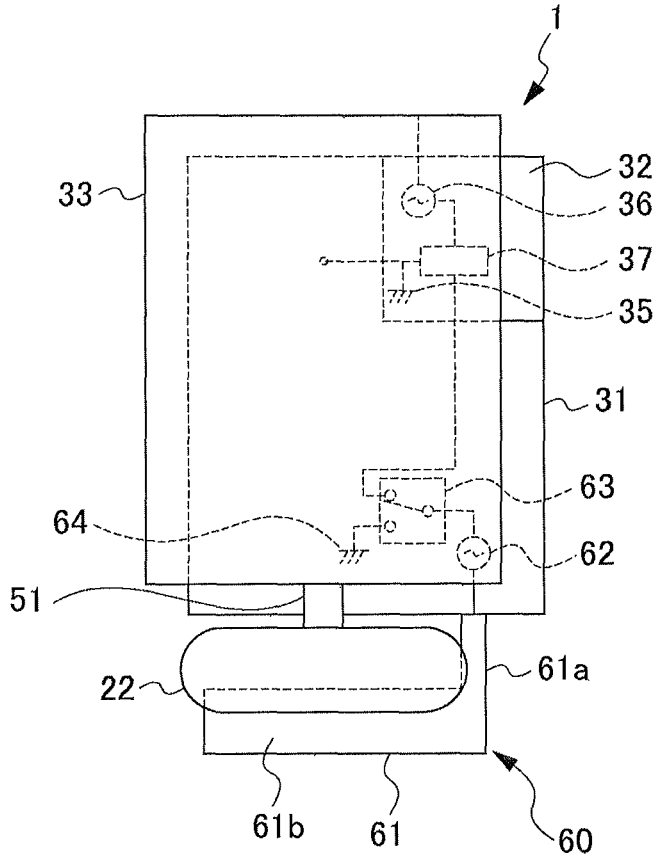
FIG. 3 is a front view schematically showing a closed state of the cellular telephone device.

Next, internal structures of the operation unit side body 2 and the display unit side body 3 are described with reference to FIGS. 2 and 3. FIG. 2 is a front view schematically showing the inside of the cellular telephone device 1 in the opened state. FIG. 3 is a front view schematically showing the inside of the cellular telephone device 1 in the closed state. It should be noted that, in FIGS. 2 and 3, only a first conductive portion 31, a circuit unit 32, an antenna unit 60 and the like are virtually shown with regard to components in the operation unit side body 2, and only a second conductive portion 33, a switching unit 51, a receiver 22 and the like are virtually shown with regard to components in the display unit side body 3.

As shown in FIGS. 2 and 3, the operation unit side body 2 includes the first conductive portion 31, the circuit unit 32 and the antenna unit 60, within the inside thereof, more specifically between the front case 2*a* and the rear case 2*b*. In the present embodiment, the first conductive portion 31 and the circuit unit 32 are configured with a circuit board 50.

The first conductive portion 31 is configured with a ground pattern formed on the area of the circuit board 50 excluding the circuit unit 32. The circuit unit 32 includes a ground unit 35, a power feed unit 36, and a signal processing unit 37 that is connected to the ground unit 35 and the power feed unit 36. The ground unit 35 is connected to the first conductive portion 31. The power feed unit 36 is connected at high frequency to the second conductive portion 33 disposed in the display unit side body 3, and feeds power to the second conductive portion 33. The signal processing unit 37 is configured with: a radio circuit including an RF circuit; a matching circuit; a control circuit; and the like. In the signal processing unit 37, predetermined processing is performed on a signal supplied from the power feed unit 36.

The antenna unit 60 includes: an antenna element 61; a sub power feed unit 62 connected to the antenna element 61; a sub switching unit 63 connected to the sub power feed unit 62; and a ground unit 64 and the signal processing unit 37 both connected to the sub switching unit 63. The antenna element 61 is provided to an end portion (a lower end portion shown in FIG. 2) opposite to the connecting portion 4 in the operation unit side body 2. The antenna element 61 is disposed adjacently to the first conductive portion 31 in the longitudinal direction of the operation unit side body 2.

The antenna element 61 is formed of a conductive material so as to be substantially L-shaped in a planar view, and includes: a first piece 61*a* that extends in the longitudinal direction of the operation unit side body 2; and a second piece

61*b* that extends integrally from the first piece 61*a* in a width direction (left-right direction shown in FIG. 2) of the operation unit side body 2. The second piece 61*b* is longer and wider than the first piece 61*a*, and functions as a radiating element of the antenna.

The sub power feed unit 62 feeds power to the antenna element 61. The sub switching unit 63 is configured to be capable of selecting from a ground unit connection state in which the ground unit 64 and the antenna element 61 are electrically connected, and a signal processing unit connection state in which the signal processing unit 37 and the antenna element 61 are electrically connected. The sub switching unit 63 operates in accordance with control of the control unit 44 (see FIG. 6). Specific operations of the sub switching unit 63 will be described later.

The display unit side body 3 is connected to the operation unit side body 2 via the connecting portion 4, such that a state of being superimposed with the operation unit side body 2 can be formed. The display unit side body 3 includes the second conductive portion 33, the receiver 22 as an electronic component, and the switching unit 51, within the inside thereof, more specifically between the front case 3*a* and the rear case 3*b*. The second conductive portion 33 is configured with a ground pattern formed on the circuit board disposed inside the display unit side body 3.

The receiver 22 is disposed to an end side (an upper side shown in FIG. 2) that is opposite to the connecting portion 4 in the display unit side body 3. The receiver 22 is disposed adjacently to the second conductive portion 33 in the longitudinal direction of the display unit side body 3. Moreover, in the closed state of the cellular telephone device 1, the receiver 22 is disposed in a position that is substantially superimposed with the antenna element 61 (the second piece 61*b* of the antenna element 61) of the operation unit side body 2 (see FIG. 3).

Figure 4:
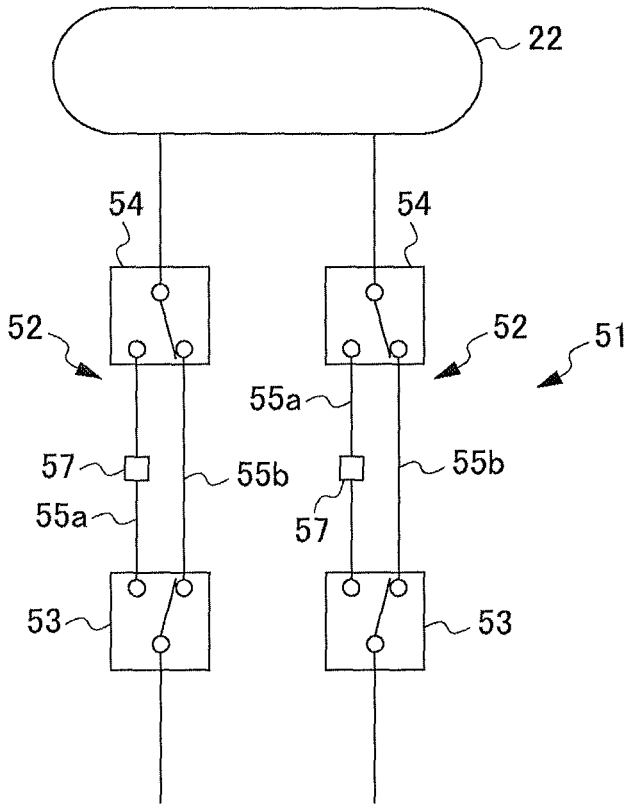
FIG. 4 is a circuit diagram showing a connection state of a switching unit in the opened state of the cellular telephone device.
Figure 5:
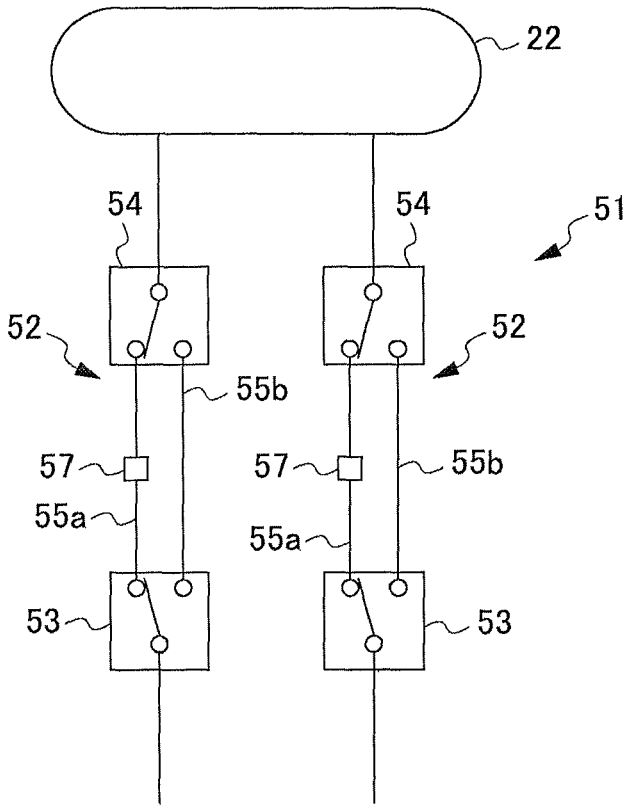
FIG. 5 is a circuit diagram showing a connection state of the switching unit in the closed state of the cellular telephone device.

Next, the switching unit 51 is described with reference to FIGS. 4 and 5. FIG. 4 is a circuit diagram showing a connection state of the switching unit 51 in the opened state of the cellular telephone device 1. FIG. 5 is a circuit diagram showing a connection state of the switching unit 51 in the closed state of the cellular telephone device 1. The switching unit 51 is configured to be capable of selecting from a first connection state (see FIG. 4) in which the second conductive portion 33 and the receiver 22 are connected at high frequency, and a second connection state (see FIG. 5) in which the second conductive portion 33 and the receiver 22 are cut off at high frequency as compared to the first connection state.

More specifically, as shown in FIGS. 4 and 5, the switching unit 51 includes two switching circuits 52 that are disposed in parallel. Each of the two switching circuits 52 has a first switching element 53 on the second conductive portion 33 side, a second switching element 54 on the receiver 22 side, and two connecting wires 55*a* and 55*b* that connect the first switching element 53 and the second switching element 54. The two connecting wires 55*a* and 55*b* in each of the switching circuits 52 are in parallel with each other, and a high-frequency cutoff unit 57 is interposed in the connecting wire 55*a*. Another connecting wire 55*b* connects the first switching element 53 and second switching element 54 that correspond to each other as the high-frequency cutoff unit 57, one having a coil or capacitor that cuts off if a high frequency is used. The switching unit 51 operates in accordance with control of the control unit 44.

Figure 6:
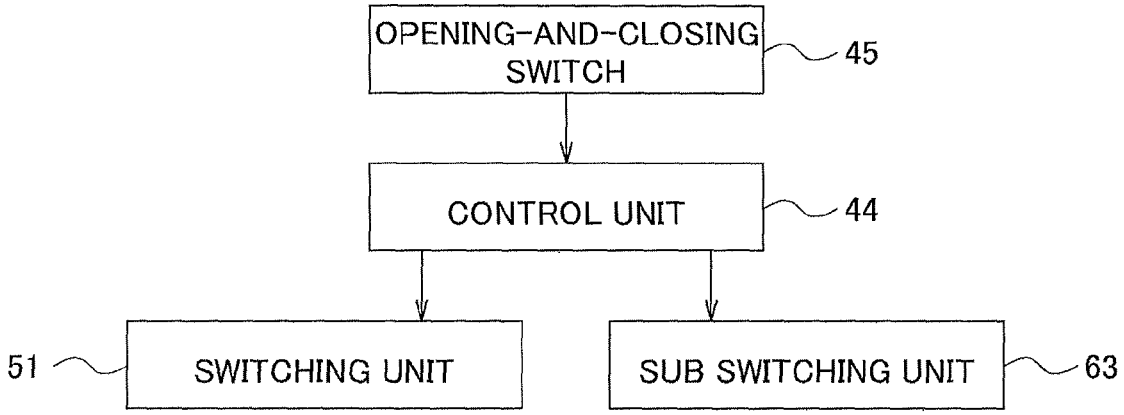
FIG. 6 is a functional block diagram showing a configuration of control of the cellular telephone device.

Next, control of the switching unit 51 and the sub switching unit 63 by the control unit 44 is described with reference to FIG. 6. FIG. 6 is a functional block diagram of the cellular telephone device 1, illustrating control of the switching unit 51 and the sub switching unit 63 by the control unit 44. As a configuration for switching the switching unit 51 and the sub switching unit 63 depending on the opened state and the closed state, the cellular telephone device 1 includes an opening-and-closing sensor 45 as a detecting unit, and the control unit 44.

The opening-and-closing sensor 45 detects the opened state and the closed state of the cellular telephone device 1. The opening-and-closing sensor 45 is configured with a magnet disposed in the operation unit side body 2 and a hall element disposed in the display unit side body 3 (none of which are illustrated), and detects the opened state and the closed state of the cellular telephone device 1. More specifically, the opening-and-closing sensor 45 detects magnetic intensity arising from the difference of the positional relationship of the operation unit side body 2 and the display unit side body 3, and determines whether the cellular telephone device 1 is in the opened state or the closed state, based on a detected result.

The control unit 44 controls the switching unit 51 and the sub switching unit 63 in accordance with the opened state and the closed state of the cellular telephone device 1 detected by the opening-and-closing sensor 45. More specifically, in a case in which the opened state of the cellular telephone device 1 is detected by the opening-and-closing sensor 45, the control unit 44 controls the switching unit 51 such that the second conductive portion 33 and the receiver 22 are connected through the connecting wire 55*b*, and connects the second conductive portion 33 and the receiver 22 at high frequency (see FIG. 4). Moreover, in this case, the control unit 44 controls the sub switching unit 63 to electrically connect the ground unit 64 and the antenna element 61, and causes the antenna unit 60 to enter the ground unit connection state.

In addition, in a case in which the closed state of the cellular telephone device 1 is detected by opening-and-closing sensor 45, the control unit 44 controls the switching unit 51 to connect the second conductive portion 33 and the receiver 22 through the connecting wire 55*a*, and cuts off the second conductive portion 33 and the receiver 22 at high frequency (see FIG. 5). Furthermore, in this case, the control unit 44 controls the sub switching unit 63 to electrically connect the signal processing unit 37 and the antenna element 61, and causes the antenna unit 60 to enter the signal processing unit connection state. It should be noted that, even in the second connection state in which the second conductive portion 33 and the receiver 22 are cut off at high frequency, the configuration allows low-frequency electric current to flow between the second conductive portion 33 and the receiver 22.

In the aforementioned cellular telephone device 1, a length L1 obtained by summation of a length of the first conductive portion 31 in the longitudinal direction of the operation unit side body 2 and a length of the antenna element 61 in the longitudinal direction of the operation unit side body 2 is substantially equal to a length L2 obtained by summation of a length of the second conductive portion 33 in the longitudinal direction of the display unit side body 3 and a length of the receiver 22 in the longitudinal direction of the display unit side body 3 (L1=L2) (see FIG. 2). Moreover, in the cellular telephone device 1, the second conductive portion 33 in the display unit side body 3 is electrically connected to the power feed unit 36, and thus functions as a radiating element of the antenna; and the first conductive portion 31 in the operation unit side body 2 is electrically connected to the ground unit 35, and thus functions as a ground unit of the antenna. Therefore, the entirety of the display unit side body 3 and the operation unit side body 2 configures a single antenna (for example, a dipole antenna).

Next, a description is provided for respective operations in the opened state and the closed state of the cellular telephone device 1 with reference to FIGS. 2 to 5.

As shown in FIGS. 2 and 4, in the opened state of the cellular telephone device 1, the control unit 44 controls the switching unit 51 to connect the second conductive portion 33 and the receiver 22 at high frequency. In addition, in this case, the control unit 44 controls the sub switching unit 63 to electrically connect the ground unit 64 and the antenna element 61, and causes the antenna unit 60 to enter the ground unit connection state. As a result, in the display unit side body 3, the second conductive portion 33 and the receiver 22 function as an antenna. Furthermore, in the operation unit side body 2, the first conductive portion 31 and the antenna element 61 function as ground. In other words, in the opened state of the cellular telephone device 1, as shown in FIG. 2, the sub switching unit 63 is in the ground unit connection state in which the ground unit 64 and the antenna element 61 are connected; therefore, the ground of the first conductive portion 31 is extended by an antenna element 61 to become large ground.

On the other hand, as shown in FIGS. 3 and 5, in the closed state of the cellular telephone device 1, the control unit 44 controls the switching unit 51 to cut off the second conductive portion 33 and the receiver 22 at high frequency. Moreover, in this case, the control unit 44 controls the sub switching unit 63 to electrically connect the signal processing unit 37 and the antenna element 61, and causes the antenna unit 60 to enter an antenna processing unit connection state. As a result, in the closed state of the cellular telephone device 1, the antenna unit 60 including the antenna element 61 functions as an antenna.

According to the cellular telephone device 1 of the present embodiment described above, the following effects are achieved. In the opened state of the cellular telephone device 1, the first conductive portion 31 and the antenna element 61 of the operation unit side body 2 are connected to the ground unit, and the second conductive portion 33 and the receiver 22 of the display unit side body 3 are connected at high frequency. Therefore, the entirety of the operation unit side body 2 and the display unit side body 3 configures an antenna (for example, a dipole antenna). As a result, the antenna sensitivity of the cellular telephone device 1 in the opened state can be improved. In addition, in the closed state of the cellular telephone device 1, the receiver 22 is cut off at high frequency. Therefore, even in a case in which the receiver 22 and the antenna element 61 are superimposed, the reduction of the antenna sensitivity of the antenna element 61 due to the presence of the receiver 22 can be suppressed. Therefore, the antenna sensitivity of the cellular telephone device 1 in the closed state can be improved. In other words, according to the cellular telephone device 1 of the present embodiment, the reduction of the antenna sensitivity can be suppressed in either cases of the opened state and the closed state.

Furthermore, even in the closed state of the cellular telephone device 1, low-frequency electric current flows between the receiver 22 and the second conductive portion 33 via the connecting wire 55*b*, and thus the function of the receiver 22 is not suspended.

Moreover, in the closed state of the cellular telephone device 1, the high-frequency cutoff unit 57 having a coil or capacitor is connected to the receiver 22; therefore, noise is removed, and favorable sound output of the receiver 22 is possible.

In addition, a configuration is employed, in which the length L1 obtained by summation of the length of the first conductive portion 31 in the longitudinal direction of the operation unit side body 2 and the length of the antenna element 61 in the longitudinal direction of the operation unit side body 2 is substantially equal to the length L2 obtained by summation of the length of the second conductive portion 33 in the longitudinal direction of the display unit side body 3 and the length of the receiver 22 in the longitudinal direction of the display unit side body 3 (L1=L2). As a result, it is possible to achieve improvement of the antenna sensitivity of a dipole antenna that is configured with the first conductive portion 31, the second conductive portion 33 and the receiver 22 in the opened state.

The cellular telephone device 1 of the present embodiment can be compatible with a signal of terrestrial digital broadcasting, a signal of CDMA (Code Division Multiple Access) communication, a signal of GPS (Global Positioning System) communication, a signal of wireless LAN, a signal of RFID, etc.

Although the preferable embodiment has been described above, the present invention is not limited to the aforementioned embodiment, and can be implemented as various embodiments. For example, the circuit unit 32 is disposed in the operation unit side body 2 in the present embodiment, but may be disposed in the display unit side body 3. In this case, operations similar to those in the aforementioned embodiment can be achieved, by connecting the second conductive portion in the display unit side body 3 to the ground unit of the circuit unit, and connecting the first conductive portion in the operation unit side body 2 to the power feed unit of the circuit unit.

Moreover, the receiver 22 is used as an electronic component that is connected to the second conductive portion 33 by the switching unit 51 in the present embodiment, but the present invention is not limited thereto. In other words, a microphone, IrDA (Infrared Data Association), a camera, an external connector or the like may be used as the electronic component.

In addition, the switching unit 51 is configured with the two switching circuits 52 disposed in parallel in the present embodiment, but the present invention is not limited thereto. In other words, the switching unit may be configured with a single switching circuit.

Furthermore, the first conductive portion 31 and the second conductive portion 33 are configured with the circuit board 50 in the present embodiment, but the present invention is not limited thereto. In other words, the first conductive portion 31 and the second conductive portion 33 may be configured with a shielding case or the like.

Moreover, the present invention is applied to the cellular telephone device 1 as a mobile terminal device in the present embodiment, but the present invention is not limited thereto. In other words, the present invention may be applied to a mobile terminal device such as a PHS (Personal Handyphone System), a PDA (Personal Digital Assistant), a portable navigation device, a notebook PC or the like.

EXPLANATION OF REFERENCE NUMERALS

1 cellular telephone device
2 operation unit side body (first body)
3 display unit side body (second body)
4 connecting portion
22 receiver (electronic component)
31 first conductive portion
32 circuit unit
33 second conductive portion
35 ground unit
36 power feed unit

37 signal processing unit
44 control unit
45 detecting unit
51 switching unit
57 high-frequency cutoff unit
60 antenna unit
61 antenna element

The invention claimed is:

1. A mobile terminal device, comprising:

a first body and a second body that are connected to be capable of transitioning between an opened state and a closed state;

a detecting unit that detects the opened state and the closed state;

a circuit unit that is disposed in one of the first body or the second body, and includes a ground unit, a power feed unit, and a signal processing unit connected to the ground unit and the power feed unit;

a first conductive portion that is disposed in the first body, and is connected to one of the ground unit and the power feed unit of the circuit unit;

a second conductive portion that is disposed in the second body, and is connected to the other one of the ground unit and the power feed unit of the circuit unit;

an antenna element that is disposed in the first body;

an electronic component that is disposed in the second body and has a third conductive portion which is superimposed with the antenna element in the closed state;

a switching unit that is configured to be capable of selecting from a first connection state in which the second conductive portion and the third conductive portion are connected at high frequency, and a second connection state in which the second conductive portion and the third conductive portion are cut off at high frequency as compared to the first connection state;

a control unit that causes the switching unit to select the first connection state in a case in which the opened state is detected by the detecting unit, and causes the switching unit to select the second connection state in a case in which the closed state is detected by the detecting unit; and a high-frequency cutoff unit including a coil or a capacitor, wherein the second conductive portion and the third conductive portion are connected via the high-frequency cutoff unit in the second connection state.

2. The mobile terminal device according to claim 1, wherein the electronic component is configured to be capable of inputting or outputting sound, and is disposed so as to be exposed in the second body in the closed state.

3. The mobile terminal device according to claim 1, wherein the electronic component includes one of a receiver, a microphone, IrDA and an external connector.

4. The mobile terminal device according to claim 1, wherein the electronic component is disposed adjacently to the second conductive portion in a longitudinal direction of the second body, wherein the antenna element is disposed adjacently to the first conductive portion in a longitudinal direction of the first body, and wherein a length obtained by summation of a length of the first conductive portion in the longitudinal direction of the first body and a length of the antenna element in the longitudinal direction of the first body is substantially equal to a length obtained by summation of a length of the second conductive portion in a longitudinal direction of the second body and a length of the third conductive portion in the longitudinal direction of the second body.

5. A mobile terminal device, comprising:

a first body and a second body that are connected to be capable of transitioning between an opened state and a closed state;

a detecting unit that detects the opened state and the closed state;

a circuit unit that is disposed in one of the first body or the second body, and includes a ground unit, a power feed unit, and a signal processing unit connected to the ground unit and the power feed unit;

a first conductive portion that is disposed in the first body, and is connected to one of the ground unit and the power feed unit of the circuit unit;

a second conductive portion that is disposed in the second body, and is connected to the other one of the ground unit and the power feed unit of the circuit unit;

an antenna element that is disposed in the first body;

an electronic component that is disposed in the second body in correspondence with the antenna element in a case in which the first body and the second body are in the closed state;

a switching unit that is configured to be capable of selecting from a first connection state in which the second conductive portion and the electronic component are connected at high frequency, and a second connection state in which the second conductive portion and the electronic component are cut off at high frequency as compared to the first connection state;

a control unit that causes the switching unit to select the first connection state in a case in which the opened state is detected by the detecting unit, and causes the switching unit to select the second connection state in a case in which the closed state is detected by the detecting unit; and a sub switching unit that is configured to be capable of selecting from a third connection state in which the ground unit and the antenna element are connected, and a fourth connection state in which the signal processing unit and the antenna element are connected, wherein the control unit causes the sub switching unit to select the third connection state in a case in which the opened state is detected by the detecting unit, and causes the sub switching unit to select the fourth connection state in a case in which the closed state is detected by the detecting unit.

* * * * *